US005653601A

United States Patent [19]

Martucci et al.

[11] Patent Number: 5,653,601

[45] Date of Patent: Aug. 5, 1997

[54] TERMINAL SOCKET ASSEMBLY

[75] Inventors: Roberto Martucci, Montegrotto T. Padova; Gianni Zuin, Mestrino-Padova, both of Italy

[73] Assignee: Molex Incorporated, Lisle, Ill.

[21] Appl. No.: 500,659

[22] Filed: Jul. 11, 1995

[51] Int. Cl.[6] ..... H01R 9/09

[52] U.S. Cl. ..... 439/82; 439/876

[58] Field of Search ..... 439/81, 82, 83, 439/874, 875, 876, 886, 853

[56] References Cited

U.S. PATENT DOCUMENTS

| | | | |
|---|---|---|---|
| 3,218,606 | 11/1965 | Schultz | 439/82 X |
| 3,222,632 | 12/1965 | Fuller | 439/876 X |
| 3,673,551 | 6/1972 | McDonough | 439/876 X |
| 4,612,602 | 9/1986 | Weyer et al. | 361/394 |
| 4,620,757 | 11/1986 | Thevenaz . | |
| 4,695,106 | 9/1987 | Feldman et al. | 439/108 X |
| 4,707,052 | 11/1987 | Bouley | 439/844 |
| 4,727,648 | 3/1988 | Savage, Jr. | 439/56 X |
| 4,902,235 | 2/1990 | Tonooka | 439/72 |
| 4,981,450 | 1/1991 | Salvatore | 439/844 |
| 5,178,564 | 1/1993 | Kachlic et al. | 439/876 |

*Primary Examiner*—Allan N. Shoap
*Assistant Examiner*—Christopher J. McDonald
*Attorney, Agent, or Firm*—Stacey E. Caldwell

[57] ABSTRACT

A terminal socket assembly is adapted for mounting on a printed circuit board and includes a conductive terminal socket having a barrel portion insertable axially into a hole in the printed circuit board, with radially outwardly projecting wing portions for soldering to solder pads on the circuit board. A terminal-receiving dielectric housing mounts the terminal socket therewithin. The housing has walls which extend circumferentially about portions of the barrel portion of the terminal socket to prevent solder from wicking along exposed areas of the terminal and interfering with mating. The anti-solder wicking design allows a connector or component to be surface mounted directly on the surface of a circuit board to maximize the density of the entire assembly and the device in which it is used.

16 Claims, 3 Drawing Sheets

TERMINAL SOCKET ASSEMBLY

FIELD OF THE INVENTION

This invention generally relates to the art of electrical connectors and, particularly, to a terminal socket assembly which prevents molten solder material from wicking or creeping along the terminal socket during processing of the socket assembly to an underlying printed circuit board.

BACKGROUND OF THE INVENTION

In hand held and portable electronic devices such as cellular phones, pagers, and two-way radios, the trend is toward smaller and more compact designs to minimize the size and weight of the device and to allow for increased density of the electronic circuitry mounted on the printed circuit boards within the devices. Therefore, it is important to maximize the density of such devices by utilizing "true surface mount" components, i.e. mounting components and connectors on both surfaces of the circuit boards, and by minimizing the distance between the printed circuit board and the connector mounted thereon. However, if components or connectors, and in particular the component or connector terminals, are placed too close to the surface of the printed circuit board, during processing of the board the reflow soldering may cause "solder-wicking" of the molten solder or spreading of the reflowed solder into exposed surfaces of the connector terminals.

The "creeping" or wicking of the solder within the terminal can interfere with the electrical connection between the connector terminals and mating component leads by increasing the insertion force of a mating pin or blocking insertion altogether, by causing solder bridging and/or short circuits within the terminal, or by causing loss of functionality of resilient beams of the terminal by reducing or eliminating contact normal forces altogether. Therefore, to minimize the risk of solder-wicking in these electronic devices, the designs typically call for spacing the connector or component away from the surface of the circuit board to create a gap which minimizes the exposed surfaces of a terminal along which the molten solder can flow. However, this approach is not necessarily consistent with the trend toward high density and compact miniaturized devices, since the gap between the circuit board and the connector takes up valuable space. Eliminating the gap by mounting the connectors and/or the components "flush" with or directly on the surface of the circuit board would allow the designs to achieve higher density.

The present invention is directed to solving the above problems by providing a surface mount terminal socket assembly which prevents solder-wicking and therefore allows the assembly to be mounted directly to the surface of the circuit board to minimize the overall profile of the assembly. The assembly can therefore be flush-mounted to the surface of a printed circuit board without the danger of problems caused by solder-wicking.

SUMMARY OF THE INVENTION

An object, therefore, of the invention is to provide a new and improved surface mount terminal socket assembly of the character described.

In the exemplary embodiment of the invention, the socket assembly is adapted for mounting on a printed circuit board. The printed circuit board includes holes with corresponding solder pads on a surface of the circuit board adjacent the holes. The socket assembly includes a conductive terminal socket having a barrel portion insertable axially into a corresponding one of the holes in the printed circuit board, and radially outwardly projecting wing portions engageable with and solderable to the solder pads on the surface of the printed circuit board. A terminal-receiving dielectric housing has a receptacle portion adapted for mounting the terminal socket therein and wall portions extending circumferentially around about at least part of the barrel portion of the terminal socket to prevent solder material from wicking or flowing along the outside of the terminal and into the internal mating portion of the terminal where it may interfere with the electrical and/or mechanical function of the terminal socket.

The wing portion of the terminal socket is axially spaced from a distal end of the socket and extends circumferentially around a portion of the barrel portion, and the wall portions of the housing extend circumferentially around substantially the remaining portion of the barrel portion of the terminal socket. As disclosed herein, the terminal socket includes a pair of the wing portions projecting radially outwardly from diametrically opposite sides of the barrel portion. The wall portions of the housing comprise a pair of walls positioned about diametrically opposite sides of the barrel portion between the wing portions. Therefore, the pair of wing portions combine to extend circumferentially around a portion of the barrel portion of the terminal socket, and the walls of the housing extend circumferentially around substantially the remaining portion of the barrel portion of the terminal socket.

The barrel portion of the terminal socket has a generally cylindrical configuration, and the housing walls are generally semi-cylindrical. The walls are sized and configured relative to the barrel portion to establish a press-fit relationship therebetween to prevent solder from flowing along exposed areas of the terminal. The terminal socket is stamped and formed of metal material and defines a seam extending longitudinally along the barrel portion thereof. One of the housing walls surrounds the seam to prevent solder-wicking therealong.

Lastly, the terminal socket includes a compliant mating portion located within the receptacle portion of the housing for resiliently engaging a mating terminal pin. The compliant portion comprises a plurality of axially extending, inwardly bowed, circumferentially spaced resilient fingers.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 3:
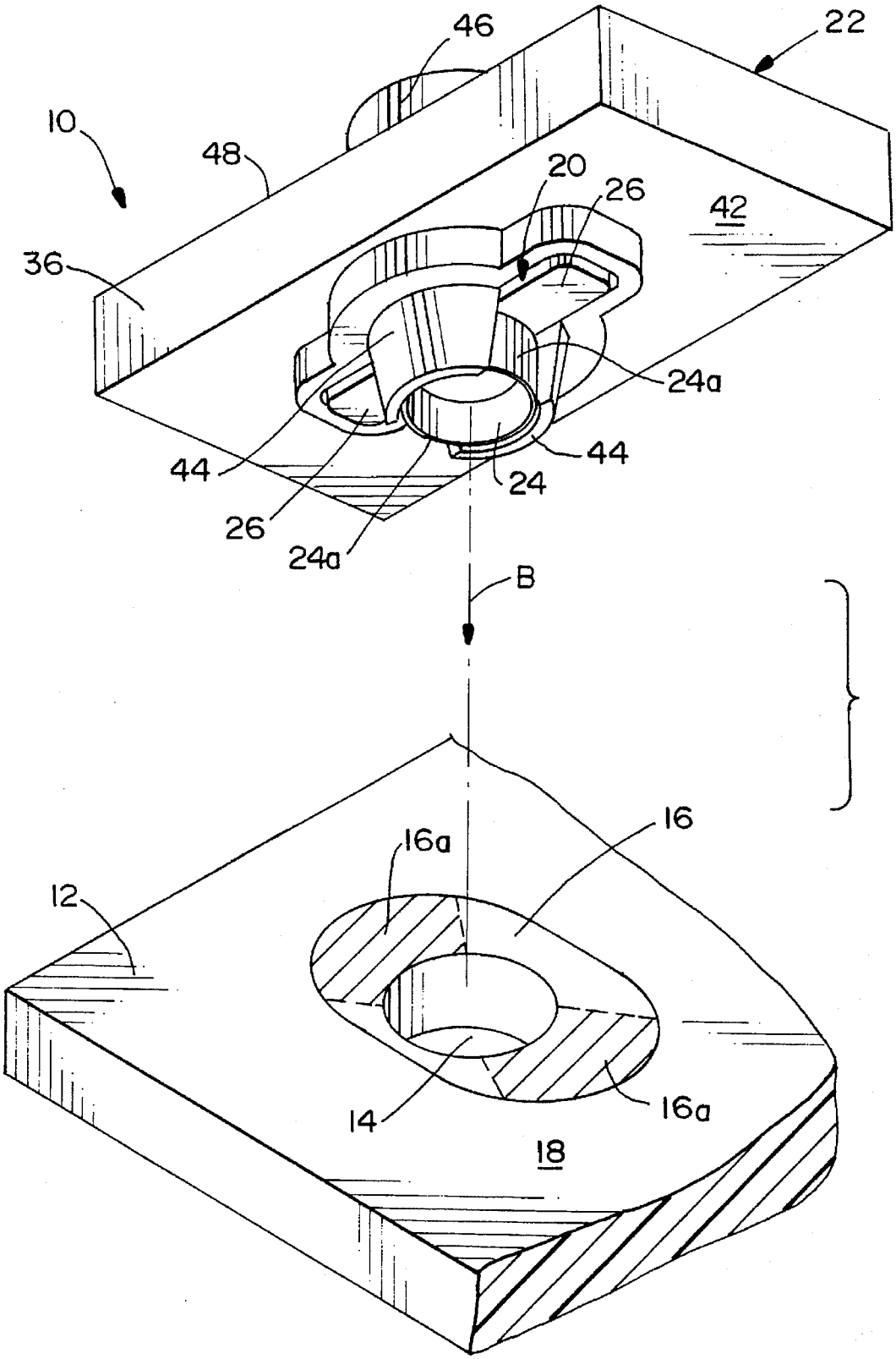
FIG. 3 is a perspective view of the socket assembly, inverted relative to the position of FIGS. 1 and 2, about to be positioned on a printed circuit board having a hole therein.

According to the invention, the terminal socket assembly, generally designated 10, is shown in FIGS. 1, 2, 4 and 5 isolated from a printed circuit board. The assembly is shown in conjunction with a printed circuit board 12 in FIGS. 3 and 6. The printed circuit board has a hole 14 therethrough, with a corresponding circuit pad 16 adjacent the hole on one surface of the board. The circuit pad is elongated as best seen in FIG. 3 to form enlarged areas 16*a* on diametrically opposite sides of hole 14, the areas being covered with a meltable or reflowable solder material as shown. The design contemplates that the solder be placed on the surface of the circuit board, to avoid costly through-hole plating processes and to allow components to be located on both surfaces of the circuit board to maximize the density thereof.

Generally in the preferred embodiment, terminal socket assembly 10 is a two-piece assembly including a one-piece conductive terminal socket, generally designated 20, and a one-piece terminal housing, generally designated 22, for mounting terminal socket 20. The terminal socket is stamped and formed of conductive sheet metal material. The housing is unitarily molded of dielectric material such as plastic or the like.

Figures 1, 2:
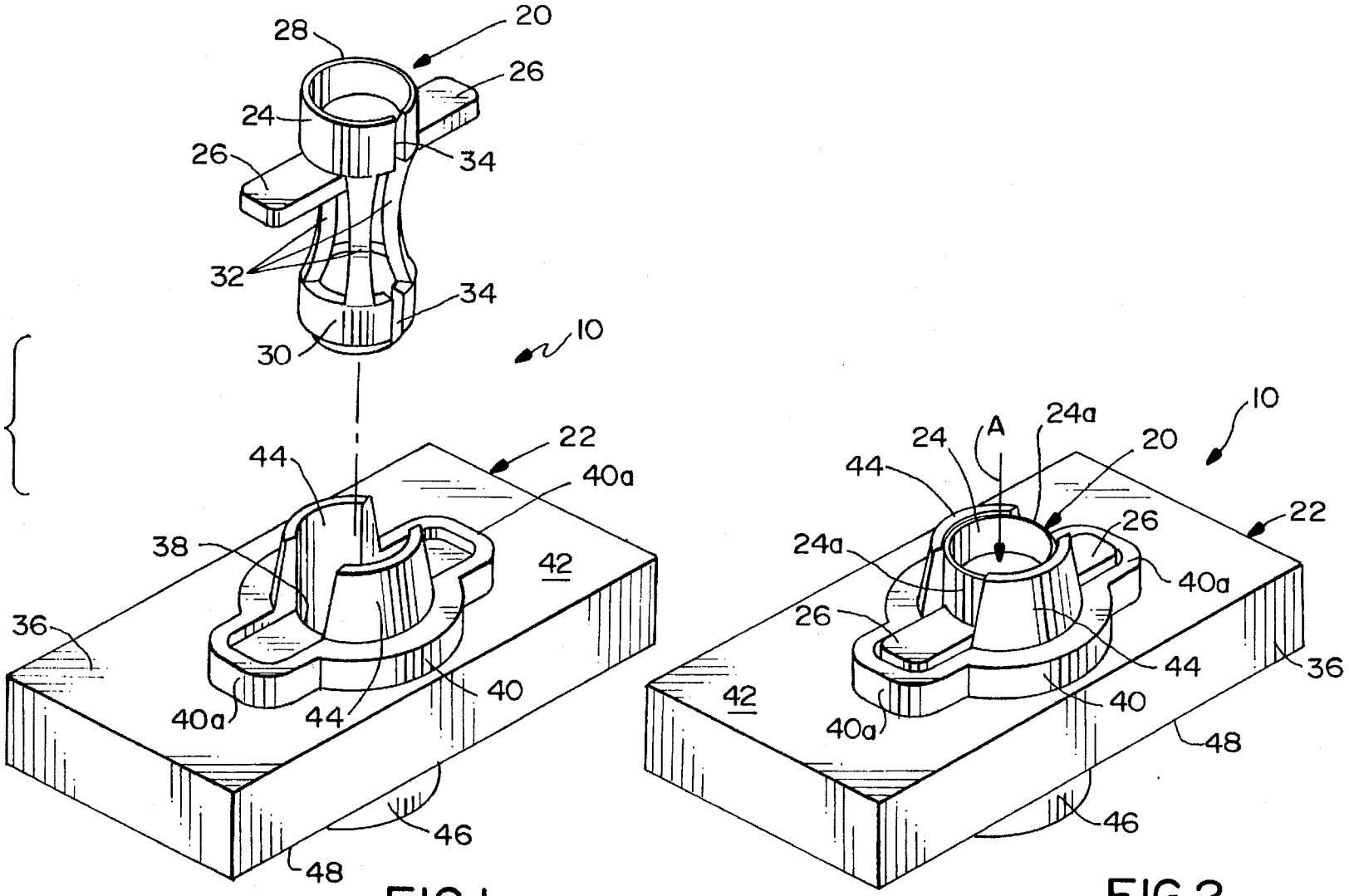
FIG. 1 is an exploded perspective view of a terminal socket assembly according to the invention.
FIG. 2 is a perspective view of the socket assembly in assembled condition.

As shown in FIG. 1, terminal socket 20 of assembly 10 includes a barrel portion 24 which defines one end of the socket for insertion into hole 14 in printed circuit board 12, as described in greater detail hereinafter. A pair of wing portions 26 project radially outwardly from opposite sides of barrel portion 24, and spaced inwardly of a distal end 28 of the socket. The terminal socket includes a compliant mating portion extending between barrel portion 24 and a second barrel portion 30 at the opposite end of the socket. The compliant mating portion is defined by a plurality of longitudinally extending, inwardly bowed and circumferentially spaced resilient mating fingers 32 which are effective to grip a mating male terminal pin or component lead (described hereinafter). Lastly, with terminal socket 20 being stamped and formed of sheet metal material, a seam 34 extends longitudinally through the socket, including through barrel portions 24 and 30 and through a pair of adjacent resilient fingers 32.

Housing 22 of terminal socket assembly 10 includes a rectangular block-shaped base 36 having a terminal-receiving passage or receptacle 38 extending therethrough for mounting terminal socket 20 therewithin. A rib 40 projects from a planar surface 42 of the base and includes radially outwardly configured rib portions 40*a* on diametrically opposite sides of receptacle 38 for surrounding wing portions 26 of terminal socket 20, as seen in FIG. 2. A pair of generally semi-cylindrical walls 44 are disposed about diametrically opposite sides of barrel portion 24 when the terminal socket is inserted into receptacle potion 38 of the housing in the direction of arrow "A" (FIG. 2). Lastly, a cylindrical boss portion 46 of housing 22 projects from an opposite planar surface 48 of base 36 to surround opposite barrel portion 30 of terminal socket 20.

Referring now to FIGS. 2 and 3, when terminal socket 20 is mounted within housing 22, areas 24*a* on opposite diametric sides of barrel portion 24 and wing portion 26 of the terminal socket are exposed for soldering to circuit board 18. The remaining portions of the outside of barrel portion 24 are substantially surrounded by walls 44 of the housing. Preferably, the walls are sized and configured relative to barrel portion 24 to establish a press-fit therebetween to ensure that molten solder material cannot flow or enter between the outside of barrel portion 24 and the insides of walls 44. In essence, wing portion 26 and areas 24*a* of barrel 24 extend circumferentially around a portion of the outside of barrel portion 24 of the terminal socket and allow for the flow of molten solder material thereover to effect a solder connection to the surface of the printed circuit board, but the remaining circumferential areas of the barrel portion, including seam 34, is substantially surrounded by walls 44 of the housing to prevent the flow of molter solder to other areas.

FIG. 3 shows terminal socket assembly 10 inverted in relation to the orientation of FIGS. 1, 2 and 4–6. This is the orientation that the assembly would assume during processing of printed circuit board 12, for example, in a reflow soldering process. The assembly is adapted to be positioned on the printed circuit board in the direction of arrow "B" such that wing portions 26 of terminal socket 20 overlie solder pad areas 16*a* of circuit pad 16 on the printed circuit board. Barrel portion 24, along with walls 44 of housing 22, project into hole 14 in the printed circuit board.

Figure 6:
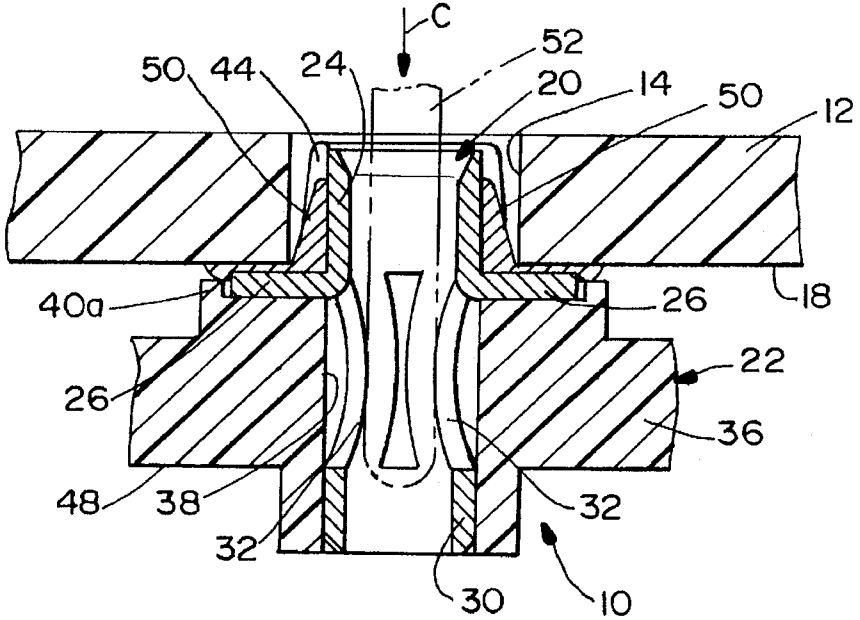
FIG. 6 is a view similar to that of FIG. 5, showing the socket assembly soldered to the printed circuit board.

Referring to FIG. 6 in conjunction with FIG. 3, solder material 50 is shown between wing portions 26 of terminal socket 20 and the surface 18 of printed circuit board 12. Although not visible in this depiction, the material would cover solder paste areas 16*a* of surface 18 of the board. Walls 44 prevent the solder from wicking circumferentially about the barrel portion and further up into the terminal socket via seam 34.

Therefore, the molten solder is confined by the socket assembly of the invention to the exposed areas 24*a* of the barrel portion (FIGS. 2 and 3), and to the radially outwardly projecting wing portions 26. The solder material can neither wick circumferentially about the barrel portion or axially into the interior of the terminal socket, due to the housing walls 44 and the terminal wing portions 26.

Figure 5:
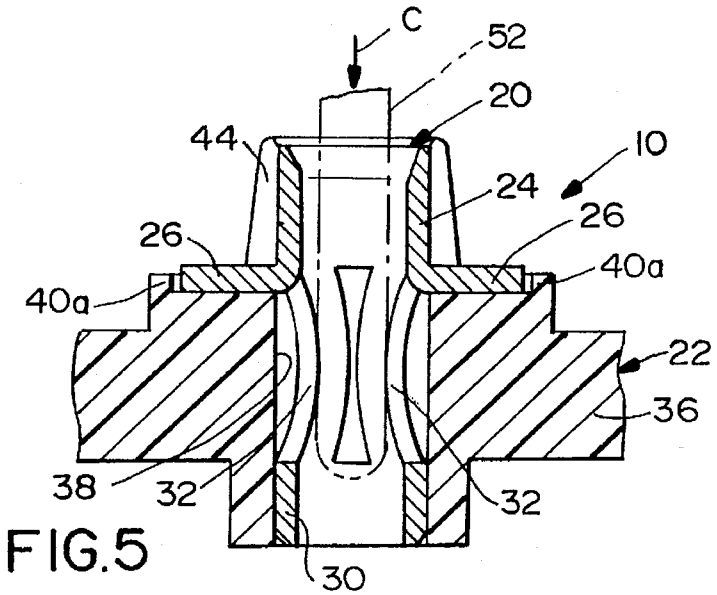
FIG. 5 is a fragmented vertical section taken generally along line 5—5 of FIG. 4.
Figure 4:
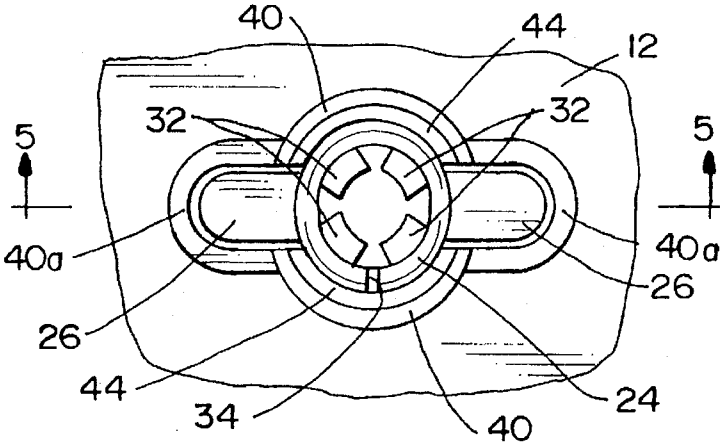
FIG. 4 is a fragmented plan view of the assembly of FIG. 2.

Lastly, FIGS. 5 and 6 show in phantom a mating terminal pin or component lead 52 which is inserted into terminal socket 20. The terminal pin is insertable in the direction of arrow "C" through barrel portion 24 and into engagement with resilient fingers 32 within the receptacle portion 38 of housing 22. Due to the design described above, solder wicking does not occur through the terminal socket and therefore no interference with the mating terminal pin can occur.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A terminal socket assembly for mounting on a printed circuit board, the circuit board having a hole with a solder pad formed on a surface of the printed circuit board adjacent the hole, the terminal socket assembly comprising:

a conductive terminal socket having a distal end with a barrel portion thereat insertable axially into the hole in the printed circuit board, and a radially outwardly projecting wing portion extending from the barrel portion and spaced from the distal end of the socket, wherein the wing portion is adapted to extend generally parallel to the surface of the printed circuit board to be engageable with the solder pad and soldered thereto; and a terminal-receiving dielectric housing for holding the terminal socket and including a wall portion projecting from a planar surface of the housing and extending about at least part of the barrel portion of the terminal socket toward the distal end thereof to prevent solder material from wicking into the terminal socket.

2. The terminal socket assembly of claim 1 wherein said wing portion of the terminal socket extends circumferentially around a portion of the barrel portion of the terminal socket, and said wall portion extends circumferentially around substantially the remaining portion of the barrel portion.

3. The terminal socket assembly of claim 1, including a pair of said wing portions projecting radially outwardly from diametrically opposite sides of the barrel portion of the terminal socket, and said wall portion of said dielectric housing comprises a pair of walls about diametrically opposite sides of the barrel portion of the terminal socket between the wing portions.

4. The terminal socket assembly of claim 3 wherein said pair of wing portions extend circumferentially around a portion of the barrel portion of the terminal socket, and said pair of housing walls extends circumferentially around substantially the remaining portion of the barrel portion.

5. The terminal socket assembly of claim 1 wherein said barrel portion of said terminal socket is generally cylindrical in shape, and said wall portion of said dielectric housing is generally semi-cylindrical in shape.

6. The terminal socket assembly of claim 5 wherein said wall portion of said dielectric housing is sized and configured relative to said barrel portion of said terminal socket to establish a press-fit relationship therebetween.

7. The terminal socket assembly of claim 1 wherein said terminal socket includes a compliant mating portion positioned within the housing for resiliently engaging a mating terminal pin.

8. The terminal socket assembly of claim 7 wherein said compliant mating portion comprises a plurality of axially extending, inwardly bowed, circumferentially spaced, resilient fingers.

9. The terminal socket assembly of claim 1 wherein said terminal socket is stamped and formed of metal material defining a seam extending longitudinally along said barrel portion, wherein said wall portion of said dielectric housing substantially surrounds the seam to prevent solder-wicking therealong.

10. A terminal socket assembly for mounting on a surface of a printed circuit board, the circuit board having a hole formed therethrough with a solder pad adjacent the hole on the surface of the printed circuit board, the terminal socket assembly comprising:

a conductive terminal socket including a distal end for receiving a mating terminal therethrough and an opposite end, the distal end having a first barrel portion insertable axially into the hole in the printed circuit board, the terminal socket further including at least one radially outwardly projecting wing portion spaced from both ends of the socket in a direction generally parallel to the surface of the printed circuit board, the wing portion positionable on the solder pad and adapted for soldering thereto, wherein the wing portion is adapted to extend along the surface of the printed circuit board, and the first barrel portion is adapted to extend through the hole in the circuit board; and a terminal-receiving dielectric housing for holding the terminal socket and including a wall portion about the first barrel portion of the terminal socket interrupted by the radially outwardly projecting wing portion to prevent solder material from wicking into the terminal socket.

11. The terminal socket assembly of claim 10 wherein said terminal socket is generally cylindrical in shape and is stamped and formed of metal material defining a seam extending longitudinally along said first barrel portion, wherein said wall portion of said dielectric housing substantially surrounds the seam to prevent solder-wicking therealong during soldering.

12. The terminal socket assembly of claim 11, including a pair of said wing portions projecting radially outwardly from diametrically opposite sides of the first barrel portion of the terminal socket, and said wall portion of said dielectric housing comprises a pair of walls about diametrically opposite sides of the first barrel portion of the terminal socket between the wing portions.

13. The terminal socket assembly of claim 10 wherein said terminal socket includes a compliant mating portion positioned within the housing for resiliently engaging a mating terminal pin.

14. The terminal socket assembly of claim 13 wherein said compliant mating portion comprises a plurality of axially extending, inwardly bowed, circumferentially spaced, resilient fingers.

15. The terminal socket assembly of claim 14 wherein the opposite end of the terminal socket includes a second barrel portion and said compliant mating portion is located generally between the first and second barrel portions.

16. The terminal socket assembly of claim 15 wherein the first and second barrel portions are sized and configured relative to said housing to establish a press-fit relationship therebetween.

* * * * *